US006474953B2

(12) United States Patent
Van De Putte

(10) Patent No.: US 6,474,953 B2
(45) Date of Patent: Nov. 5, 2002

(54) COMPRESSOR CONTROL SYSTEM AND METHOD FOR CONTROLLING THE SAME

(75) Inventor: Daniël Jan Josephine Van De Putte, Kontich (BE)

(73) Assignee: Atlas Copco Airpower, naamloze vennootschap, Wilrijk (BE)

( * ) Notice: Subject to any disclaimer, the term of this patent is extended or adjusted under 35 U.S.C. 154(b) by 0 days.

(21) Appl. No.: 09/789,564

(22) Filed: Feb. 22, 2001

(65) Prior Publication Data

US 2001/0046443 A1 Nov. 29, 2001

(30) Foreign Application Priority Data

Feb. 22, 2000 (BE) ..... 000137

(51) Int. Cl.[7] ..... F04B 49/06

(52) U.S. Cl. ..... 417/44.2; 417/53; 417/228; 418/87; 184/6.16

(58) Field of Search ..... 417/44.2, 44.4, 417/53, 13, 19, 29, 228; 418/84, 87, 97, 79; 184/6.16, 26, 29

(56) References Cited

U.S. PATENT DOCUMENTS 3,105,630 A * 10/1963 Lowler et al. ..... 230/31
3,260,444 A * 7/1966 Williams et al. ..... 230/138
3,788,776 A * 1/1974 Post et al. ..... 417/295
3,860,363 A * 1/1975 Silvern et al. ..... 417/12
3,961,862 A * 6/1976 Edstrom et al. ..... 417/282
4,052,135 A * 10/1977 Shoop et al. ..... 417/295
4,063,855 A * 12/1977 Paul ..... 418/84
4,180,986 A * 1/1980 Shaw ..... 62/192
4,358,247 A * 11/1982 Suzuki et al. ..... 417/13
4,403,722 A * 9/1983 Nikolich ..... 227/8
5,318,151 A * 6/1994 Hood et al. ..... 184/61
6,123,510 A * 9/2000 Greer et al. ..... 417/53

FOREIGN PATENT DOCUMENTS

JP 03237288 10/1991
JP 06010876 1/1994

* cited by examiner

*Primary Examiner*—Charles G. Freay
*Assistant Examiner*—Han L. Liu
(74) *Attorney, Agent, or Firm*—Bacon & Thomas, PLLC

(57) ABSTRACT

The invention relates to a method for controlling a compressor installation with at least one lubricated screw-type compressor element (1) connected to a pressure vessel (11) which is driven by an electric motor (10) which is regulated in function of the compression pressure, and which compresses the gas supplied through the gas inlet conduit (2). The return flow of lubricating agent through the return conduit (7) also is determined by a controlled valve (9) which is provided with a calibrated opening (29) and which is controlled by control means (43) which, as the number of revolutions of the screw-type compressor element (1) has dropped below a well-defined value, put the controlled valve (9) into the position in which it restricts the return flow of lubricating agent to a flow through the calibrated opening (29).

8 Claims, 3 Drawing Sheets

COMPRESSOR CONTROL SYSTEM AND METHOD FOR CONTROLLING THE SAME

BACKGROUND OF THE INVENTION

1. Field of the Invention

This invention relates to a method for controlling a compressor installation with at least one lubricated screw-type compressor element connected to a pressure vessel, which element is driven by an electric motor with continuously adjustable speed and to which a gas inlet conduit is connected, a gas outlet conduit is connected which is provided with an outlet valve, and a return conduit for lubricating liquid is connected which is provided with a closing valve, which screw-type compressor element compresses the gas supplied through the gas inlet conduit from a lower pressure to a higher, pre-set pressure, according to which method the speed of the motor is regulated in function of the compression pressure and therefore is diminished as the pressure in the pressure vessel obtains a certain value and, inasmuch as necessary, the motor is stopped in a programmed manner.

2. Discussion of the Related Art

In known methods, when the compressor element is working under load, as soon as the compression pressure and therefore the pressure in the pressure vessel have obtained a maximum value, then the motor is slowed down until a programmed stop command stops it possibly completely, and the screw-type compressor element comes to a standstill.

During the last stage of this slowing down, the outlet valve and the closing valve in the return conduit still are open in order to keep the temperature of the compressed air under control, and the number of revolutions is reduced to such an extent that in the screw-type compressor element a surplus of lubricating liquid is created by means of the return conduit and the closing valve. The quantity of lubricating liquid flowing back to the screw-type compressor element as long as the closing valve in the return conduit is open, in fact is determined by the pressure in the valve.

At low speeds of the screw-type compressor element, an accumulation of lubricating liquid in the screw-type compressor element may occur.

As this lubricating liquid is not compressible, then, as a result of hydraulic forces, at low speeds the load torque of the compressor element can increase considerably.

This also has as a consequence that, with the first subsequent start, the driving motor has to overcome a very high resistive torque, to which end particularly high electric powers are necessary.

This may cause a motor damage or failure of the drive or necessitates a corresponding over-dimensioning of the drive.

SUMMARY OF THE INVENTION

The invention has as an object a method for controlling a compressor installation which avoids the aforementioned and other disadvantages and which, when the speed-regulated, lubricated screw-type compressor element is running out, stopping and re-starting, avoids a surplus supply of lubricating liquid and, as a consequence thereof, the failure of the drive of said screw-type compressor element.

To this aim, according to the invention, the return flow of lubricating agent through the return conduit also is determined by a controlled valve which is provided with a calibrated opening and which is controlled by control means which, when the number of revolutions of the screw-type compressor element has dropped below a well-defined value, put the controlled valve into the position in which it restricts the return flow of lubricating agent to a flow through the calibrated opening and which remove this restriction when the number of revolutions surpasses a well-defined value.

As a result hereof, the load torque keeps its normal value and, therefore, starting problems are avoided.

The control of the controlled valve can take place by controlling a three-way valve in a conduit between the pressure vessel and a chamber inside the controlled valve, which three-way valve in one position connects said chamber to the pressure vessel, such that the pressure in the pressure vessel effects on the valve body of the controlled valve, and in a second position connects said chamber to the atmosphere, whereby the control means put the three-way valve into the first position when the number of revolutions of the motor drops below a well-defined value.

When the pressure in the pressure vessel obtains a well-defined value, preferably the motor and, therefore, the screw-type compressor element are stopped in two stages and during this stopping procedure, when the number of revolutions has dropped below a well-defined value, the controlled valve is put into the position whereby it restricts the return flow of lubricating agent, after which the motor further slows down until a programmed stop command stops it entirely and the screw-type compressor element comes to a standstill.

The invention also relates to a compressor installation which is particularly suited for the application of said method.

Thus, the invention relates to a compressor installation with at least one lubricated screw-type compressor element; a gas inlet conduit connected to this screw-type compressor element and a gas outlet conduit, provided with an outlet valve; an electric motor coupled to said screw-type compressor element with continuously adjust-able speed; a pressure vessel connected to the gas outlet conduit; a return conduit for lubricating agent, provided with a closing valve, between the pressure vessel and the interior side of the screw-type compressor element; and control means for controlling the speed of the motor in function of the compression pressure and to give a stop signal thereto in a programmed manner, and which is characterised in that in the return conduit, between the closing valve and the screw-type compressor element, a controlled valve is installed, with a calibrated opening which in one position closes off the return conduit, with the exception of the calibrated opening, and in another position allows a normal flow through the return conduit.

In known compressor installations, a closing valve indeed is present in the return conduit for the lubricating agent, but no additional controlled valve.

BRIEF DESCRIPTION OF THE DRAWINGS

With the intention of better showing the characteristics of the invention, hereafter, as an example without any limitative character, a preferred embodiment of a method for controlling a compressor installation and of a compressor installation controlled in this manner, according to the invention, is described, with reference to the accompanying drawings, wherein.

DESCRIPTION OF THE PREFERRED EMBODIMENT

Figure 1:
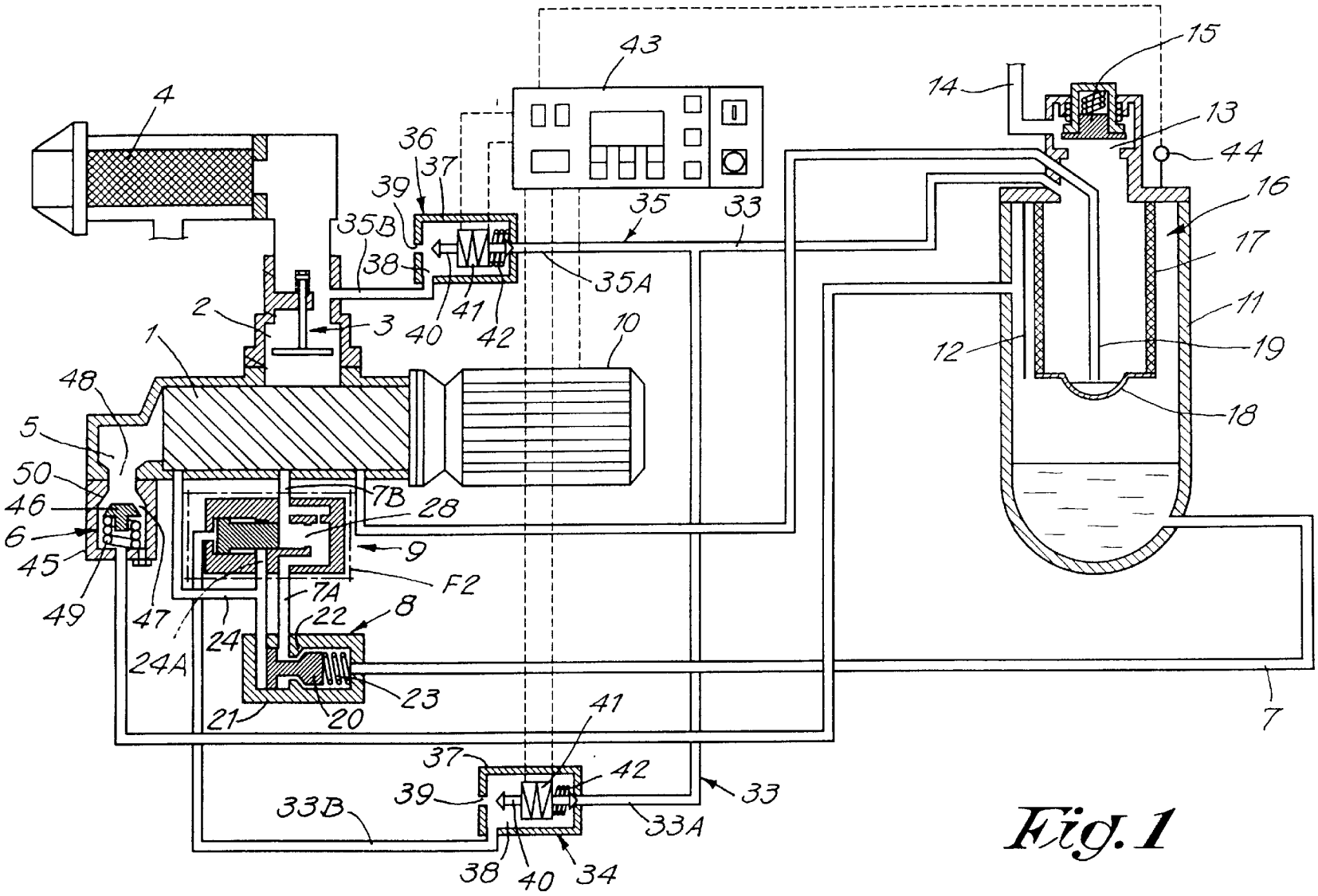
FIG. 1 schematically represents a compressor installation according to the invention, during working at a nominal speed.

A compressor installation, shown in FIG. 1 comprises a screw-type compressor element 1 having two rotors, not represented in the figure for simplicity's sake, which rotors are installed rotatably in a housing, whereby this screw-type compressor element 1 is provided with a gas inlet conduit 2 in which possibly a return valve 3 is provided and to which a gas filter 4 is connected, and which element 1 is provided with a gas outlet conduit 5 in which an outlet valve 6 is provided.

This screw-type compressor element 1 is oil-injected and the oil which forms the lubricating liquid is introduced at a location where there is no overpressure during working, through a return conduit 7 in which a closing valve 8 and, between this latter and the screw-type compressor element 1, a controlled valve 9 are provided.

The screw-type compressor element 1 and more particularly the male rotor thereof is driven by an electric motor 10 with continuously adjustable speed, more particularly a frequency-controlled motor 10.

Further, the compressor installation comprises a pressure vessel 11 connected to the gas outlet conduit 5, to the underside of which the return conduit 7 is connected. At the top, the gas outlet conduit 5 gives out in this pressure vessel 11, opposite to a vertical screen 12 installed therein.

At the opposite side of said screen 12, in the upper part of this pressure vessel 11, before the outlet 13 which, by means of a conduit 14, is in connection with the consuming points and which can be closed off by means of a minimum pressure valve 15, an oil-separating element 16 is situated which, in the represented example, is a coalescence filter element. This coalescence filter element consists of a tubular element 17 with one or more layers of a filter material in which the fine oil particles in the compressed air agglomerate to larger droplets and precipitate, and a collecting bottom 18 which closes off the tubular element 17 at the underside for collecting said oil droplets. In the middle, this collecting bottom 18 is provided with a deepening.

A suction conduit 19 which protrudes with an extremity into said deepening, is directly connected to the interior side of the screw-type compressor element 1.

The closing valve 8 comprises a valve body 20 which is movable in a housing 21 in respect to a valve seat 22 and onto which, on one hand, a spring 23 is effecting which pushes said valve body 20 towards the valve seat 22 and, on the other hand, the pressure is effecting which originates from the outlet of the screw-type compressor element 1, by means of a conduit 24 which in its turn gives out into the gas outlet conduit 5 at the upper side of the outlet valve 6 or, as represented in FIG. 1, in the proximity of the gas outlet conduit 5 at the interior side of the screw-type compressor element 1.

The controlled valve 9 comprises a valve body 25 which is movable in a housing 26 in respect to a valve seat 27. As represented in detail in FIGS. 2 and 4, the valve body 25 consists of a closing part 25A and a control part 25B with a larger diameter which, thus, protrudes laterally out of the closing part 25A and which forms a piston.

Figure 2:
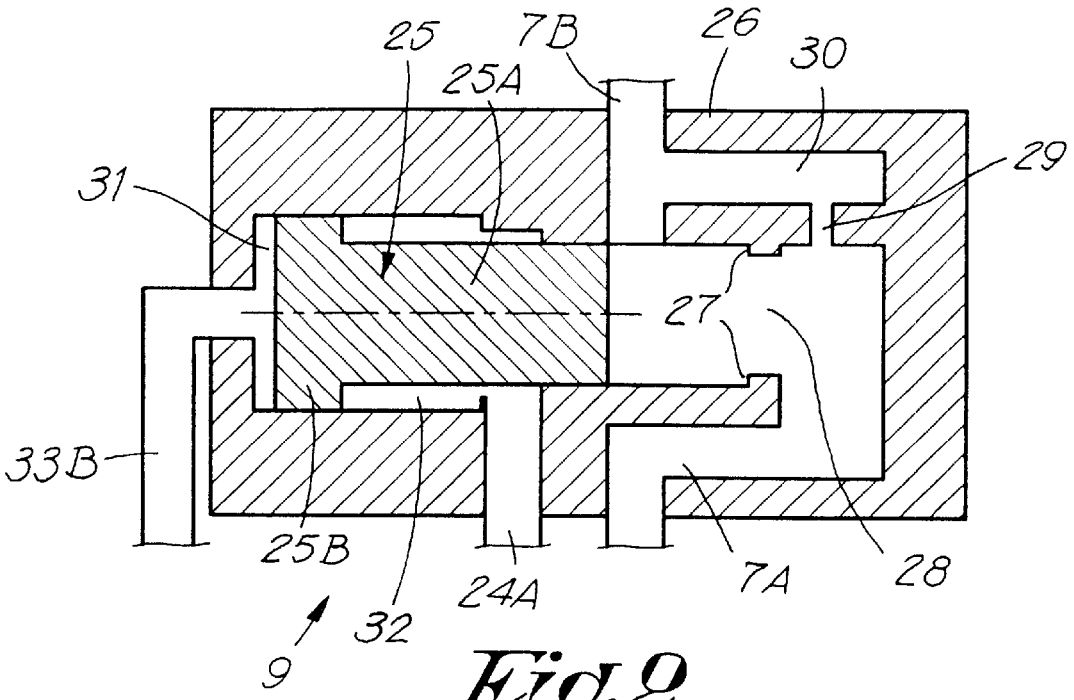
FIG. 2, at a larger scale, represents the part indicated by F2 in FIG. 1.

Between the closing part 25A and the opposed wall of the housing 26, a relatively large chamber 28 remains in which the valve seat 27 is situated and which is maximum when the closing part 25A is situated at the largest distance from its valve seat 27, as represented in FIG. 2.

At the side of the closing part 25A in respect to the valve seat 27, the part 7B of the return conduit 7 connected to the screw-type compressor element 1 is connected to this maximum chamber 28.

At the other side of the valve seat 27, the part 7A of the return conduit 7 coming from the outlet of the closing valve 8 gives out into this chamber 28, and a calibrated opening 29 gives out with which this chamber 28, through a channel 30, is in a permanent connection with the part 7B of the return conduit 7 situated in between the controlled valve 9 and the screw-type compressor element 1. The calibrated opening 29 offers a considerably smaller passage than the return conduit 7.

When the valve body 25 is in the extreme position represented in FIGS. 1 and 2, free from the valve seat 27, and therefore the controlled valve 9 is open, then the parts 7A and 7B of the return conduit 7 are directly connected to each other by means of the chamber 28.

Figure 4:
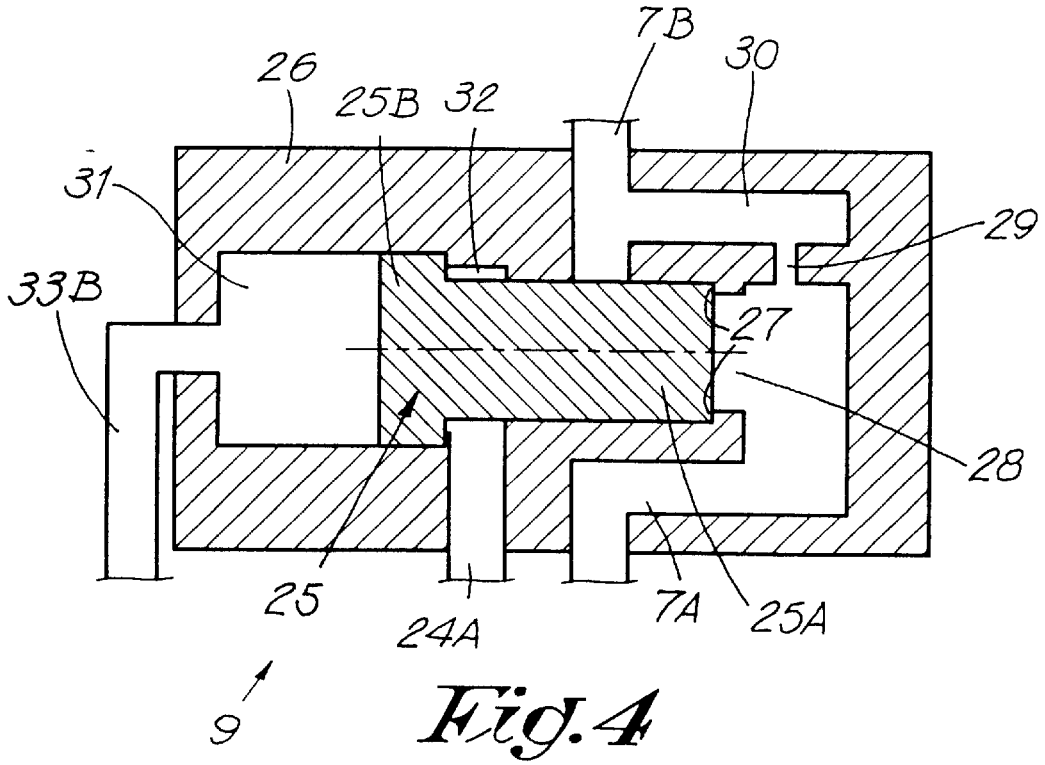
FIG. 4, at a larger scale, represents the part indicated by F4 in FIG. 3.

When the valve body 25 is in its other extreme position, and thus the closing part 25A fits against the valve seat 27, as represented in FIG. 4, then the part 7A of the return conduit 7 is in connection with the part 7B only by means of the chamber 28, the calibrated opening 29 and the channel 30. Between the side of the control part 25B directed away from the closing part 25A and the opposed wall of the housing 26, a chamber 31 remains, whereas at the other side, around the closing part 25A between the radially protruding wall of the control part 25B and a narrowing of the housing 26, a ring-shaped chamber 32 remains.

Even if the valve body 25 is situated against its valve seat 27, the chamber 32 still takes up a minimum into which a branch 24A of said conduit 24 is giving out, such that the chamber 32 is in permanent connection with the gas outlet conduit 5, upstream of the outlet valve 6 or, as represented in FIG. 1, in the proximity of the gas outlet conduit 5, with the interior of the screw-type compressor element 1, this is with the outlet part of this latter.

The aforementioned chamber 31 is connected to the outlet 13 of the pressure vessel 11 by means of a conduit 33 in which a three-way valve in the form of a solenoid valve 34 is provided.

Moreover, the conduit 33 or the outlet 13 are in connection with the gas inlet conduit 2 by means of a conduit 35 with therein a second three-way valve in the form of a solenoid valve 36, between the return valve 3 and the gas filter 4.

Both solenoid valves 34 and 36 are three-way, two-position valves and therefore comprise a housing 37, to the interior of which two parts 33A and 33B of conduit 33, 35A and 35B of conduit 35, respectively, are connected, whereas the third way is formed by an opening 39 which is situated transversely opposite to the opening of the part 33A or 35A at the interior side 38 and which connects said interior side 38 to the atmosphere.

In the housing 37, a valve body 40 is situated which is formed by the movable core of a solenoid 41 and which is pushed by a spring 42 towards the position in which it closes off the opening of the part 33A of conduit 33, the part 35A of conduit 35, respectively.

When the solenoid 41 is activated, the valve body 40 compresses the spring 42 and closes off opening 39, whereas the opening of the last-mentioned part 33A or 35A in the interior side 38 of the housing 37 is open, such that the parts 33A and 33B, 35A and 35B, respectively, are in connection with each other by means of this interior side 38.

When the solenoid 41 is not activated, the spring 42 pushes said valve body 40 against the opening of the part 33A, 35A, respectively, which then is closed off.

The solenoids 41 of the two solenoid valves 34 and 36 are fed by control means 43 which also by the intermediary of a frequency regulator control the speed of the motor 10 in function of the pressure in the pressure vessel 11 measured by a pressure gauge 44 and which can give an electric stopping signal to this motor 10.

The outlet valve 6 is a return valve and comprises a housing 45 in which a valve body 46 is arranged. By means of a passage 47 which can be closed off by the valve body 46, the interior of the housing 45 is in connection with an outlet chamber 48 which forms part of the gas outlet conduit 5. A spring 49 pushes the valve body 46 towards a seat 50 situated around the passage 47.

The installation described in the foregoing is controlled as follows.

During normal operation, when the screw-type compressor element 1 is loaded, the return valve 3 is open as a result of a negative pressure present at the inlet part of the screw-type compressor element 1.

In FIG. 1, the compressor installation is represented during normal operation, with loaded screw-type compressor element 1.

The outlet valve 6 is held open by means of the compression pressure, and the closing valve 8 is open, too, as this compression pressure is exerted onto the valve body 20 through conduit 24.

The solenoid 41 of the solenoid valve 36 is not activated, and the opening of the part 35A of the conduit 35 is closed off by its valve body 40.

As a result thereof, it is prevented that gas under pressure originating from the pressure vessel 11 should be blown off through conduits 33 and 35 and gas filter 4.

The solenoid 41 of the solenoid valve 34 also is not activated, and the part 33A of conduit 33 is closed off by the valve body 40, as represented in FIG. 1.

As a result thereof, the pressure in the chamber 31 of the controlled valve 9 is considerably lower than the pressure in the chamber 32 which corresponds to the pressure at the outlet of the screw-type compressor element 1 increased by the pressure present in the chamber 28, and the valve body 25 is in open position, as represented in FIG. 2.

Oil collected beneath pressure vessel 11 can flow back by means of the open closing valve 8 and the chamber 28, by means of which the parts 7A and 7B of the return conduit 7 are in connection with each other.

When the pressure measured by the pressure gauge 44 obtains a well-defined maximum value, the control means 43 command the slowing down of the motor 10.

When during the stopping procedure the number of revolutions of this motor 10 has dropped below a well-defined value, then the control means 43 command the closing of the controlled valve 9 by activating the solenoid 41 of the solenoid valve 34.

Thereby, the valve body 40 will be forced by spring 42 into the position in which opening 39 is closed off.

Figure 3:
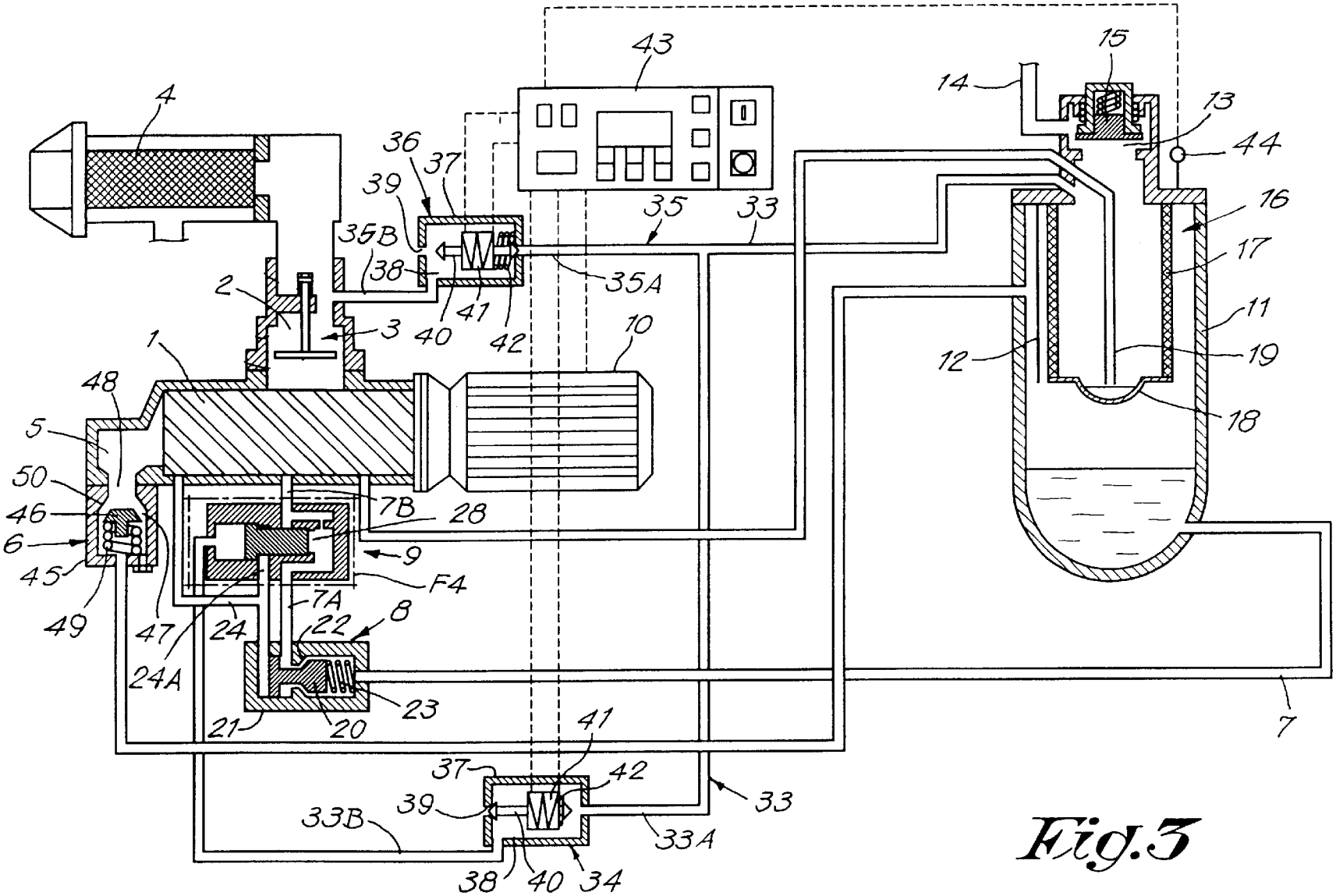
FIG. 3 schematically represents the compressor installation of FIG. 1, but during working at a low speed and with a restricted return flow of oil.

In FIG. 3, the compressor installation is represented after the closing of said controlled valve 9, whereas in FIG. 4, the controlled valve 9 is represented in closed condition.

As a result of the control pressure which, by means of the conduit 33 which is no longer interrupted by solenoid valve 34, is prevailing in the chamber 31, the valve body 25 of the controlled valve 9 will be pressed against the valve seat 27, against the pressure in the chambers 28 and 32, as a result of which the return conduit 7 is interrupted, with the exeption of the calibrated opening 29 which forms the sole connection between the chamber 28 and the part 7A of return conduit 7, on one hand, and the channel 30 and, therefore, the part 7B of return conduit 7, on the other hand.

The controlled valve 9 is represented in this position in FIGS. 3 and 4.

Now, oil can flow back only through this calibrated opening 29 and thus with a limited flow rate, such that during the low speed stage, less oil will flow back to the screw-type compressor element 1 than usual.

This has as a consequence that the screw-type compressor element 1 is not overcharged with oil and that the load torque will not surpass its normal level.

Due to the standstill of the rotors of the compressor element 1, the return valve 3 will close. Due to this standstill, as well as to the pressure prevailing in the gas outlet conduit 5 and the pressure vessel 11, outlet valve 6 will close, too.

As a consequence of the closing of outlet valve 6, the connection to the pressure vessel 11 is interrupted and the control pressure in conduit 24 towards closing valve 8 ceases, such that the valve body 20 is pressed against its valve seat 22 by the spring 23, and a rapid closing of the closing valve 8 is caused.

The controlled valve 9 remains in its closed condition represented in FIGS. 3 and 4, as also the control pressure in branch 24A and in chamber 32 has ceased and the chamber 31, by means of conduit 33, remains in connection with the pressure vessel 11.

After the motor 10 and thus the rotors of the screw-type compressor element 1 have come to a standstill, the screw-type compressor element 1 is brought to an equal pressure with the pressure vessel 11, by means of suction conduit 19 which returns oil from inside the tubular element 17 directly to the interior of the screw-type compressor element 1.

When the pressure in the pressure vessel 11 measured by pressure gauge 44 has dropped below a well-defined value, then the control means 43 command the re-starting of the screw-type compressor element 1.

When during starting, the number of revolutions of the motor 10 surpasses a well-defined value, then the control means 43 command the interruption of the activation of solenoid 41 of the solenoid valve 34, as a result of which opening 39 is opened and chamber 31 of the controlled valve 9, by means of part 33B of conduit 33 and said opening 39, is connected to the atmosphere.

As a result thereof, the pressure in chamber 31 will cease and, due to the pressure supplied through conduit 24 and branch 24A to chamber 32, the valve body 25 will regain its open position, represented in FIGS. 1 and 2.

Due to the opening of the controlled valve 9, the oil again can be brought into the screw-type compressor element 1, through return conduit 7 and closing valve 8, at full flow rate.

By opening and closing the controlled valve 9 in a suitable manner by means of control means 43, the efficient operation of the screw-type compressor element 1 in respect to cooling, lubrication and load torque is guaranteed at any moment.

By activating the solenoid 41 of solenoid valve 36, the part 35A of conduit 35 can be opened and put into connection with the part 35B, such that in this manner the compressed air from pressure vessel 11 can be blown off through gas filter 4, if necessary.

When, after the standstill of the screw-type compressor element 1, the pressure in the pressure vessel 11 is not depressurised, as in the example described heretofore, then conduit 35 remains closed off by means of solenoid valve 36.

The method and device described in the foregoing allow to apply the continuously adjustable speed regulation of the motor 10 in a compressor installation, which results in a very advantageous specific capacity. Stopping and restarting are performed while maintaining the pressure in the pressure vessel 11, such that compressed air may be delivered immediately.

The lubricating liquid does not necessarily have to be oil. It may, for example, also be water. Gases other than air can be compressed.

The invention is in no way limited to the form of embodiment described in the foregoing and represented in the figures; on the contrary, such method and compressor installation may be realised in different variants without leaving the scope of the invention.

What is claimed is:

1. A method for controlling a compressor installation having at least one lubricated screw-type compressor connected to a pressure vessel and being driven by an electric motor having continuously adjustable speed settings, said compressor connected to a gas inlet conduit, a gas outlet conduit having an an outlet valve, and a return conduit having a closing valve, said method comprising the steps of:

compressing gas supplied by said gas inlet from a lower pressure to a higher, predetermined pressure valve by said compressor;

regulating the speed of the electric motor of said compressor as a function of compression pressure, said motor speed decreasing as said pressure in said pressure vessel approaches a predetermined pressure value, said motor stopping when the pressure in said pressure value reaches said predetermined pressure value; and regulating the transport of the lubricating agent through the return conduit with a control valve having a calibrated opening and being controlled by a control device, wherein as the number of revolutions of the compressor drops below a predetermined number of revolutions, said control valve is urged into a position that restricts the flow of the lubricating agent through said calibrated opening, said control value releasing flow restriction of the lubricating agent when said number of revolutions exceed said predetermined number of revolutions.

2. The method of claim 1 further comprising the step of controlling said control valve with a three-way valve disposed in a conduit positioned between said pressure vessel and a chamber defined in said control valve, in a first position said three-way valve connects said pressure vessel to said chamber such that pressure in said pressure vessel acts upon a valve body positioned in said control valve, and in a second position said three-way valve connects said chamber to the atmosphere, said control device urging said three-way valve into the first position when the number of revolutions of said motor drops below said predetermined number of revolutions.

3. The method of claim 1 wherein said motor of said compressor is stopped in two stages when pressure in said pressure vessel exceeds the predetermined pressure value, wherein said first stage said control valve is urged into a position to restrict the flow of said lubricating agent when the number of revolutions drops below said predetermined number of revolutions, and wherein said second stage said motor slowing down until a programed stop command completely stops said motor to thereby stop operation of said compressor.

4. A compressor installation comprising:

at least one lubricated screw-type compressor;

a gas inlet conduit connected to said compressor;

a gas outlet conduit having an outlet valve and connected to said compressor element;

an electric motor having continuously adjustable speed settings and coupled to said compressor;

a pressure vessel connected to said gas outlet valve;

a return conduit configured to transport a lubricating agent and positioned between said pressure vessel and said compressor, said return conduit including a closing valve and a control valve, said control valve positioned between said closing valve and said compressor, said control valve having a calibrated opening defined therein, wherein a first position said control valve terminates flow in said return conduit except through said calibrated opening, and wherein a second position said control valve permits steady flow through said return conduit; and a control device configured to control the speed of said compressor motor as a function of the compression pressure and provide a stop signal to said compressor motor when the compression pressure reaches a predetermined criteria.

5. The compressor installation according to claim 4 wherein the control valve comprises:

a housing;

a valve body movable within said housing, said valve body having a closing part at one end and a control part extending laterally from said closing part;

a first chamber defined between said closing part and one wall of said housing located opposite said closing part, said first chamber connecting to said pressure vessel;

a valve seat configured in said first chamber, said return conduit communicating with opposite sides of said valve seat; and a second chamber defined between a side of said control part directed away from said closing part and another wall of said housing opposite to said one wall thereof, said second chamber communicating with said pressure vessel; and an annular chamber defined between said closing part, said control part and a narrowing of said housing near said valve seat, said annular chamber maintaining constant communication with said gas outlet conduit and said compressor;

wherein said calibrated opening communicates with said first chamber along one side thereof opposite to another side thereof whereat said valve seat communicates with said closing part, said calibrated opening maintaining constant communication between said one and another sides of said first chamber when said valve body is in an open position.

6. The compressor installation according to claim 5 wherein a three-way valve is disposed in said first chamber and controlled by said control device said three-way valve including a valve body that connects portions disposed along opposite sides of said three-way valve in a first position and connects said chamber to the atmosphere in a second position.

7. The compressor installation according to claim 4 wherein the closing value in the return conduit includes a housing and a valve body movable therein, a portion of the housing positioned along one side of said valve body being connected by a conduit to said compressor.

8. The compressor installation according to claim 4 further comprising a conduit between the pressure vessel and the gas inlet conduit, a three-way valve controlled by a control device positioned within said conduit wherein a first position said three-way valve terminates flow in said conduit between said three-way valve and said pressure vessel, and wherein a second position said three-way valve permits steady flow through said conduit and connects said three-way valve with the atmosphere for depressurizing said pressure vessel.

* * * * *